United States Patent [19]

Egri, II

[11] Patent Number: 4,791,766

[45] Date of Patent: Dec. 20, 1988

[54] METALLIC FRAMING FIRE-STOP

[76] Inventor: John D. Egri, II, 5200 Moore Rd., Lincoln, Calif. 95648

[21] Appl. No.: 94,848

[22] Filed: Sep. 10, 1987

[51] Int. Cl.[4] ..... E04C 1/00

[52] U.S. Cl. ..... 52/317; 52/696

[58] Field of Search ..... 52/320, 321, 348, 349, 52/350, 317, 667, 696, 693, 713, 481; D29/1

[56] References Cited

U.S. PATENT DOCUMENTS

| | | | |
|---|---|---|---|
| D. 262,068 | 11/1981 | Wilson | D29/1 |
| 457,985 | 8/1891 | Eastman | 52/320 X |
| 734,781 | 7/1903 | Walker et al. | 52/349 |
| 837,090 | 11/1906 | Makowski | 52/696 |
| 840,111 | 1/1907 | Collins | 52/696 |
| 885,439 | 4/1908 | Collins | 52/696 |
| 893,815 | 7/1908 | Schutt | 52/696 |
| 1,867,449 | 7/1932 | Eckert et al. | 52/317 X |
| 2,099,961 | 11/1937 | McLaughlin, Jr. | 52/317 X |
| 3,778,952 | 12/1973 | Souey | 52/667 |
| 4,453,362 | 6/1984 | Rodgers | 52/713 X |
| 4,628,651 | 12/1986 | Morettin et al. | 52/317 X |
| 4,715,153 | 12/1987 | Rohrman | 52/667 X |

FOREIGN PATENT DOCUMENTS

| | | | |
|---|---|---|---|
| 379880 | 9/1907 | France | 52/384 |

*Primary Examiner*—David A. Scherbel
*Assistant Examiner*—Richard E. Chilcot, Jr.
*Attorney, Agent, or Firm*—Leon Gilden

[57] ABSTRACT

A metallic frame fire-stop is set forth formed of planar-like reinforced rib construction including necked-down terminal end portions with integral interlock elements for twist-fit locking engagement with typical metallic studding, as commonly utilized in commercial construction. The width of the fire-stop members are dimensioned to equal those of metallic studding with the neck-down terminal end portions dimensioned to nest within the metallic studding's vertical legs. The so formed fire-stop accordingly require no accessory fastening elements for securement to the aforenoted studding.

7 Claims, 3 Drawing Sheets

METALLIC FRAMING FIRE-STOP

BACKGROUND OF THE INVENTION

1. Field of the Invention

The present invention relates to fire-stops, and more particularly it pertains to a new and improved fire-stop apparatus Which is formed with integral securement tabs enabling an immediate secure twist fit interlocking with commercial type metallic studding. Cooperating neck-down terminal shoulders formed at either end portion of the invention enables the so-formed fire-stop to interfit between vertical legs of the aforenoted studding.

2. Description of the Prior Art

The use of fire-stops in the construction trade is well known in the prior art. Fire codes, as well as prudent construction, requires that these devices be positioned at various vertical heights between studding or framework of construction walls to discourage the spread of fire throughout that construction by minimizing air flow or draft to a fire in progress. While fire-stops have been utilized extensively in cooperation with conventional wood frame studding, an application to metallic studding, as is currently the building trend, has not been developed Time consuming and labor intensive separable fasteners have been utilized to position fire-stops throughout such metallic framing or studding. The interlock system of the present invention creates a stronger, unitized construction and hastens the completion of a structure by reducing man hours thereby providing immediate economic as well safety advantages. An example of a prior art fire-stop is set forth in U.S. Pat. No. 498,663 to Montgillion. The patent provides for a universal-type fire-stop of two readily movable interrelated sections that are spread to fit between associated vertical studs and by the use of nails, screws or other attached means, is affixed to said studs. This earlier patent is noteworthy in that the construction trade has not progressed substantially beyond these early-type patents to provide a fire-stop that is immediately installed on site requiring a minimum of expertise, effort, or labor.

A further prior art patent is set forth in U.S. Pat. No. 1,412,736 to Hamilton. The Hamilton patent presents somewhat of an improvement over the previously noted Montgillion patent in that integral burrs are formed to enable temporary securement of the fire-stop device to associated wood studding enabling subsequent attachment by means of separate fasteners such as nails. While an improvement in application to wood framing, the Hamilton patent, as the other prior art, provides no means of effecting rapid permanent securement of the fire-stop in time sensitive commercial construction.

U.S. Pat. No. 1,195,097 to Saino is yet another in a series of fire-stops for utilization in cooperation with wood framing including means for attachment to such frames by use of separate fasteners to protect the underlying framework and accordingly includes the same labor intensive shortcomings as previous prior art devices.

U.S Pat. No. 1,428,881 provides a different approach utilizing fire-stops for wood framing where serrated teeth are positioned at terminal portions of a fire-stop where vertical attachment forces are translated into longitudinal movement through the fire-stop member and enables attachment of the fire-stop into wood framing and accordingly provides no further improvement in fire-stop construction.

U.S. Pat. No. 2,994,114 issued to Black sets forth a fire-stop with associated ear-like members to embrace adjacent studs wherein said ear-like members include integrally formed attachment means for securement to said studs. Accordingly, the subsequent need for ancillary tools and positioning of said fire-stops renders the Black patent similar to other prior devices and is of minimal improvement in fire-stops and of little or no application to metallic framework of contemporary construction.

U.S. Pat. No. 1,867,449 to Ecket sets forth a fire-stop formed of metallic construction with accessory ears and attachment plates for securement to studs in an effort to expedite the positioning of such stud fire-stops within framework but as in other prior devices, provides no twist-in attachment to studding and requires accessory tools and the attendant additional time of installation for utilization of such a fire-stop device.

U.S. Pat. No. Des. 271,849 illustrates a fire-stop formed of metallic construction with alternating ears at terminal end portions thereof with what appears to be sharpened protuberances for use between wall studs. The application of this patent to Kendallckunz is again strictly utilized with wood studding as there is no illustrated means of securing such a fire-stop between metallic framework members.

As such is may be appreciated that there is a continuing need for a new and improved metallic fire-stop which addresses both the problem of reinforcement and draft halting ability when positioned in place and furthermore, ease of attachment that is lacking in the prior art, and in this respect the present invention substantially fulfills this need.

SUMMARY OF THE INVENTION

In view of the foregoing disadvantages inherent in the known types of fire-stops now present in the prior art, the present invention provides a fire-stop for use with metallic studding that may be compactly stored and transported when not in use and may further be readily and efficiently twist-locked into position of locked inter-engagement with associated vertical metallic studding. As such, the general purpose of the present invention, which will be described subsequently in greater detail, is to provide a new and improved metallic studding fire-stop which has all the advantages of the prior art fire-stops and none of the disadvantages.

To attain this, the present invention comprises an elongate fire-stop of ribbed reinforced construction. Proximate terminal end portions of said fire-stop, the longitudinal edges thereof bottleneck to a reduced dimensional width to be accepted within a like dimensional distance between legs of an associated metallic wall stud of contemporary configuration. At the remote respective ends of my invention projecting truncated triangular-like projections interfit within pre-formed openings in said metallic wall studs for a secure inner-locking relationship therewith. The resultant structure produces a strengthened metallic framework as well as an effective fire-stop.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar a they do no depart from the spirit and scope of the present invention.

Further, the purpose of the foregoing abstract is of enable the U.S. Patent and Trademark Office and the public generally, and especially the scientists, engineers an practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fire-stop which has all the advantages of the prior art fire-stops and none of the disadvantages.

It is another object of the present invention to provide a new and improved fire-stop which may be easily and efficiently manufactured and marketed.

It is a further object of the present invention to provide a new and improved fire-stop which is of a durable and reliable construction.

An even further object of the present invention is to provide a new and improved fire-stop which is susceptible of a low cost of manufacture with regard to both materials and labor, and which accordingly is then susceptible of low prices of sale to the consuming public, thereby making such fire-stop economically available to the buying public.

Still yet another object of the present invention is to provide a new and improved fire-stop which provides in the apparatuses and methods of the prior art some of the advantages thereof, while simultaneously overcoming some of the disadvantages normally associated therewith.

Still another object of the present invention is to provide a new and improved fire-stop for use with contemporary metallic framework of either "H" or "U" shaped configuration.

Yet another object of the present invention is to provide a new and improved fire-stop including a reduced bottleneck edge portion at either end to be received within a like configuration of associated metallic studding.

Even still another object of the present invention is to provide a new and improved fire-stop formed with integral tab-like interlocking elements to twist-lock and interfit with companion openings within metallic framing or studding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
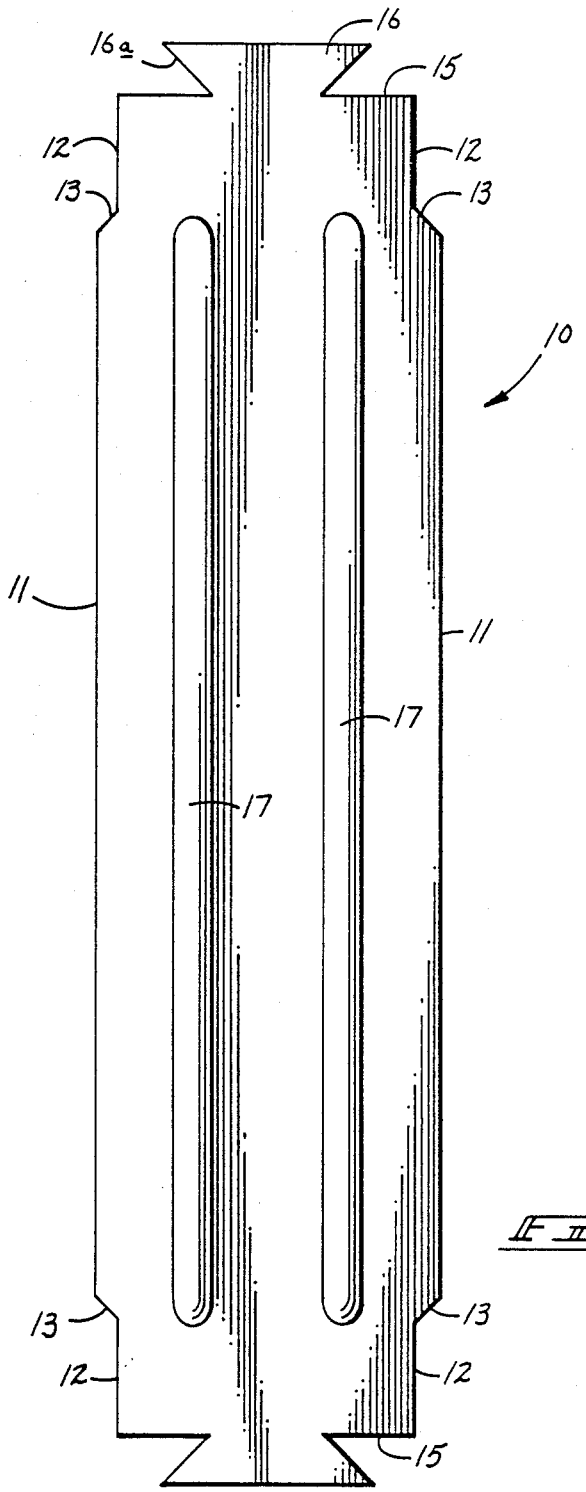
FIG. 1 is a top orthographic view of the present invention illustrating its various configurations, parts and relationship.

With reference now to the drawings, and in particular to FIG. 1 thereof, a new and improved fire-stop embodying the principles and concepts of the present invention and generally designated by the reference numeral 10 will be described.

Figure 2:
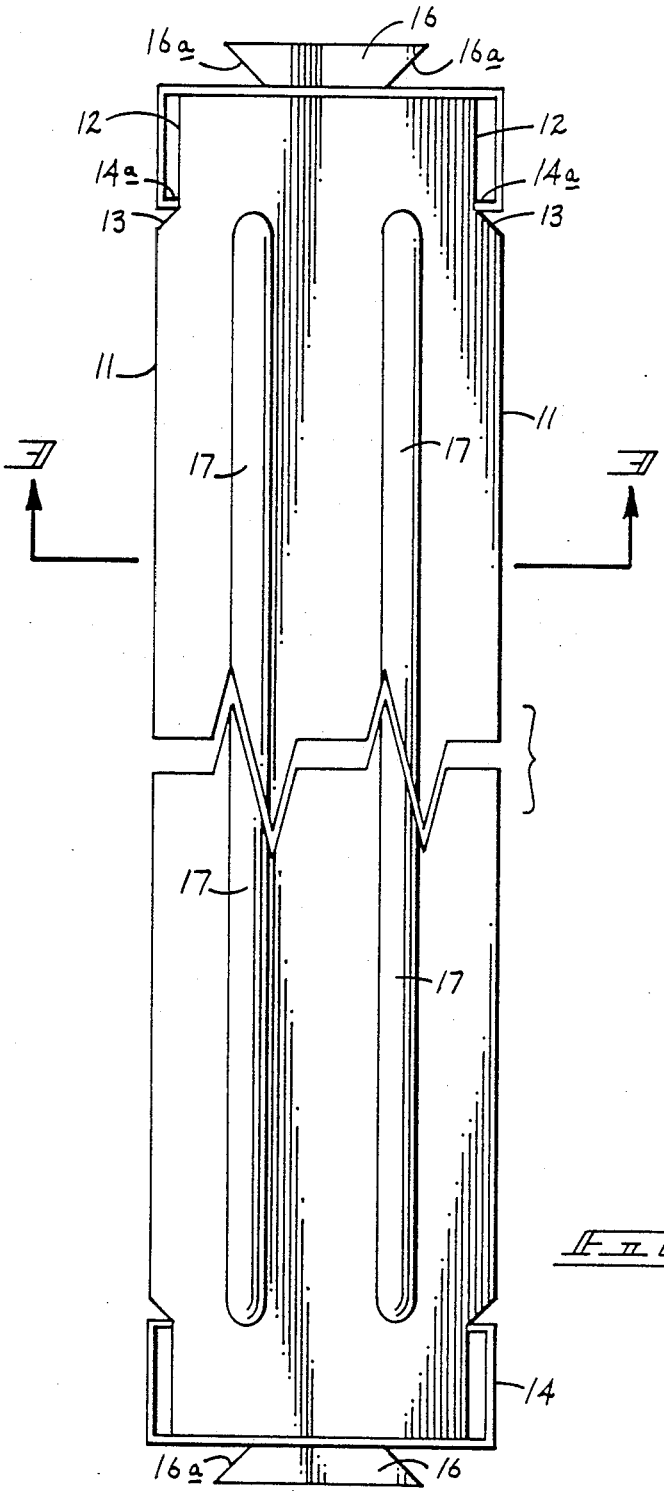
FIG. 2 is a top orthographic view of the present invention illustrating the fire-stop in interlocking engagement with associated metallic studding.

More specifically it will be noted that a new fire-stop apparatus 10 essentially comprises a linear extending member formed of first linear longitudinal surfaces 11 terminating at either end thereof into second reduced longitudinal surfaces 12 of a dimension to substantially equal the internal dimension of a "U" or "H" shaped metallic stud at its narrowest measurement between ears **14*a* integrally formed onto respective legs, as illustrated in FIG. 2**.

With reference to FIG. 2, the inner relationship of fire-stop 10 to a metallic studding is illustrated and particularly it may be noted that tapered transition shoulders 13 are dimensioned to create a slight interference to fit with projecting ears **14*a* of metallic stud 14. Furthermore the linear length of fire-stop 10 between terminal end portion 15 of my invention is dimensioned to be substantially the distance between spaced metallic studs 14 locking tabs 16 projecting beyond end portions 15 of my fire-stop 10 are formed in a truncated triangular configuration, as illustrated per FIG. 2. The sloping sides 16*a* when in interfitting relationship with openings within studs 14 create a locking interference to accommodate manufacturing dimensional variations of stud 14. The interference fit between studs 14 and tapered shoulders 13 and sloping sides 16*a* create a plural locking arrangement between my fire-stop and each stud that not only performs the function of effecting a fire-stop but also creates an additional structural element within the framework that adds rigidity and strength to a completed matrix structure that includes studs 14 and fire-stops 10**.

To increase structural rigidity during manipulation and to add overall strength to a final construction and interrelationship between studs 14 and fire-stops 10, reinforcing ribs 17 are formed longitudinally of fire-stops 10, as illustrated. The particular configuration of reinforcing ribs 17 is not critical and may include a variety of shapes and configurations to add necessary rigidity and may be either cast or stamped within fire-stops 10 dependent upon composition and manufacturing technique of fire-stops 10.

Figure 3:
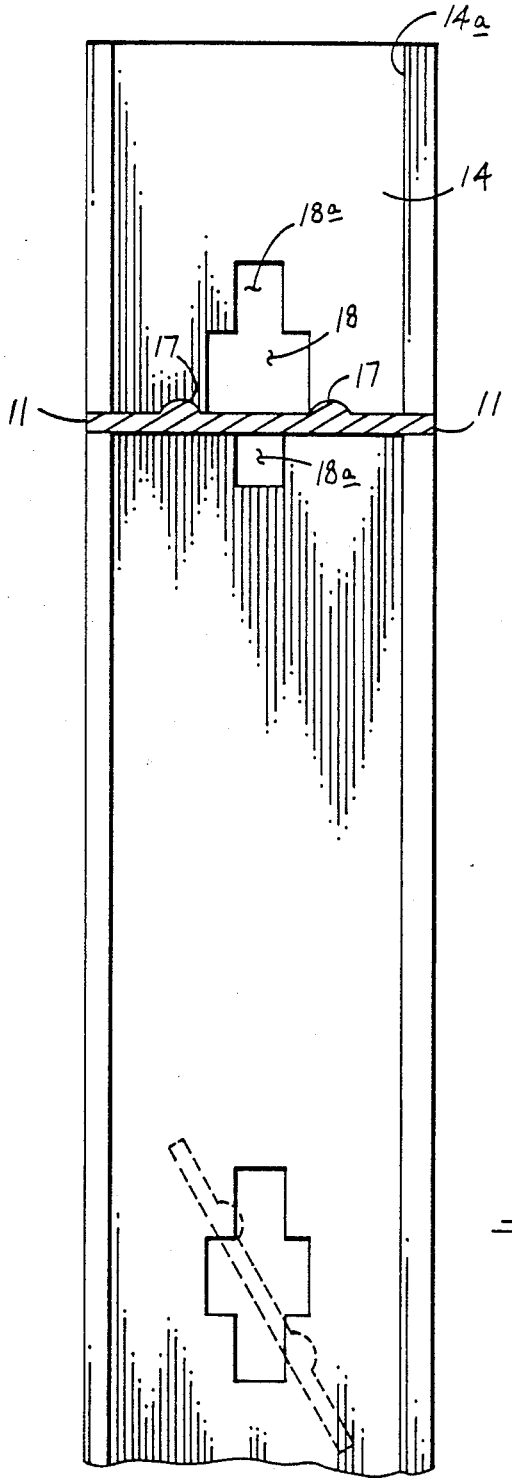
FIG. 3 side orthographic view of the present invention taken along the lines 3—3 in FIG. 2 in the direction indicated by the arrows.

FIG. 3 illustrates fire-stops 10 in a final locked interrelationship with a stud 14 engaged within a pre-formed opening 18, as are typically formed within such studding. Adjunct leg openings 18*a* enable positioning of locking tabs 16 therethrough and providing adequate space for projecting of tabs 16 and final engagement of sloping sides 16*a* with the vertical sides of opening 18 after subsequent rotational position of fire-stop 10. The lower opening in FIG. 3 of stud 14 illustrates in phantom the fire-stop 10 in initial position relative to stud 14 prior to locked inter-engagement therewith. With further reference to FIG. 3, it should be noted that upon final positioning and interlocking engagement with metallic studs 14, fire-stop 10 is dimensioned of a width between first lineal longitudinal surfaces 11 to substantially equal the Width of metallic studs 14 to create an effective draft resistant fire-stop.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Leters Patent of the United States is as follows:

1. A metallic fire-stop for use with metallic studs wherein said studs are formed with a spaced opening, said fire-stop comprises a metallic plate-like member formed of a finite length defined by parallel first linear longitudinal surfaces to define a width of said fire-stop, and each of said first surfaces terminating in a par of tapered transition shoulders, and second surfaces spaced beyond said first surfaces, and each of said shoulders positioned between said first surfaces and said second surfaces, and said second surfaces terminating in end surfaces to define a main body of said fire-stop, and locking tab means secured into each end surface projecting longitudinally outwardly thereof for inter-engagement with said openings in said metallic studs.

2. A metallic fire-stop as set forth in claim 1 where each of said locking tabs are configured in the shape of truncated triangular portions.

3. A metallic fire-stop as set forth in claim 2 wherein said locking tabs further include tapered side portion means for interference inter-engagement with said openings of said metallic studs.

4. A metallic fire-stop as set forth in claim 1 wherein a distance defined between said second surfaces of said main body is of a distance less than said width defined between said first longitudinal surfaces.

5. A metallic fire-stop as set forth in claim 1 wherein said tapered transition shoulders are positioned for an interference fit between projecting ears formed integrally with said metallic studs.

6. A metallic fire-stop as set forth in claim 1 wherein at least one reinforcing rib is formed longitudinally and integrally within said main body of said fire-stop.

7. A metallic fire-stop as set forth in claim 1 wherein said tabs are integrally secured onto each of said end surfaces.

* * * * *